US005916379A

United States Patent [19]

Varley et al.

[11] Patent Number: 5,916,379

[45] Date of Patent: Jun. 29, 1999

[54] TREATMENT OF FERROUS METAL SURFACES

[75] Inventors: Michael John Varley; John Bryan Thomas, both of Swansea, United Kingdom

[73] Assignee: Abbey Research & Development Ltd., Dyfed, United Kingdom

[21] Appl. No.: 08/794,079

[22] Filed: Feb. 4, 1997

[30] Foreign Application Priority Data

Feb. 6, 1996 [GB] United Kingdom ..... 9602344

[51] Int. Cl.[6] ..... C23C 22/00

[52] U.S. Cl. ..... 148/252; 106/14.13; 134/3; 134/28; 134/41; 266/113

[58] Field of Search ..... 106/14.13; 134/3, 134/41, 28; 148/252; 266/113

[56] References Cited

U.S. PATENT DOCUMENTS

| | | | |
|---|---|---|---|
| 2,529,178 | 12/1950 | Nieland et al. | 422/17 |
| 3,547,787 | 12/1970 | Parsons | 205/193 |
| 3,973,998 | 8/1976 | Datta | 134/28 |
| 4,264,418 | 4/1981 | Wood et al. | 134/3 |
| 5,296,042 | 3/1994 | Curran et al. | 134/41 |
| 5,332,511 | 7/1994 | Gay et al. | 210/755 |

FOREIGN PATENT DOCUMENTS

| | | |
|---|---|---|
| 0 158 566 | 10/1985 | European Pat. Off. . |
| 0 595 686 A1 | 5/1994 | European Pat. Off. . |
| 2 656 630 | 7/1991 | France . |
| 56-072162 | 6/1981 | Japan . |
| 55-165192 | 11/1987 | Japan . |
| 63-125687 | 5/1988 | Japan . |
| 1-234583 | 9/1989 | Japan . |
| 4064362 | 2/1992 | Japan . |
| 473 910 | 6/1969 | Switzerland . |
| 1125942 | 12/1965 | United Kingdom . |
| 1184144 | 7/1968 | United Kingdom . |
| 1241538 | 4/1970 | United Kingdom . |
| 1298536 | 7/1971 | United Kingdom . |
| 2 170 517 | 8/1986 | United Kingdom . |
| WO 95/30781 | 11/1995 | WIPO . |

OTHER PUBLICATIONS

M. Kurahashi et al. "Cleaning of Piping System for Functional Liquid," *Chemical Abstacts* (Dec. 1988) 109(26): 255.

*Primary Examiner*—David A. Simmons
*Assistant Examiner*—Robert R. Koehler
*Attorney, Agent, or Firm*—Townsend and Townsend and Crew LLP

[57] ABSTRACT

Disclosed herein are a composition comprising an aqueous solution of a gluconate salt and a citrate salt for treatment of a ferrous metal surface, and a method of application of such a composition for the protection of the ferrous metal surface against corrosion by inhibition of the formation of stop stain caused by the flash rusting.

8 Claims, No Drawings

TREATMENT OF FERROUS METAL SURFACES

BACKGROUND OF THE INVENTION

Mild steel strip of the type produced by hot rolling generally has widths of 4 to 6 ft (1.2 to 1.8 m) and continuous lengths of 2000 ft (600 m) or so. The thickness will depend largely upon the final intended use, for example for pressing into vehicle body panels. The hot rolling process has the inevitable consequence of generating an oxide coating (rust) on the freshly formed surface of the strip, and therefore after leaving the rolling mill the strip is pickled. Pickling involves passing the strip continuously through a series of baths (generally four baths) containing hot (85° C.) hydrochloric acid and generally ferrous chloride, the acid strength increasing through the baths to about 10%. The acid from the final bath is squeegeed off and the strip is then rinsed, first in cold demineralized water and finally in hot demineralized water which serves to heat the steel and promote evaporation of residual water from its surface. Rinsing generally takes the form of spraying the strip with water from above and from below as it passes through the rinse section of the pickle line.

In order to maintain a degree of continuity in the pickle line, it is usual to weld the trailing end of the strip in the pickle line to the leading end of the next strip to be pickled. This welding process necessitates bringing the strip to a stop in the pickle line and in the downstream rinse section thereof while the welded joint is made, and it has been found that flash rust (stop stain) frequently occurs on the stationary strip in the rinse section. Numerous attempts have been made over the years to eliminate or minimize this problem which manifests itself as orange stains on the steel surface. The quantity and severity of staining does of course vary but may affect a total of up to 50 ft (15 m) of the length of the strip and may result in the whole strip being rejected as unsatisfactory by the customer.

SUMMARY OF THE INVENTION

The present invention has been developed in an attempt to eliminate the stop stain caused by flash rust on the steel surface without interrupting or affecting the throughput of the pickle line.

In accordance with a first aspect of the invention, there is provided a composition for treating a ferrous metal surface comprising an aqueous solution of a gluconate salt and a citrate salt.

The invention also provides in a second aspect a method for protecting a ferrous metal surface against corrosion which comprises applying such a composition to the ferrous surface.

DETAILED DESCRIPTION OF THE INVENTION AND PREFERRED EMBODIMENTS

The gluconate and citrate salts included in the composition of the invention are most suitably alkali metal salts, preferably sodium salts in view of their ready commercial availability. Generally the solution will contain from 3 to about 15% by weight each of the gluconate and the citrate, the lower limit being governed by the need to provide adequate flash rust prevention and the upper limit being governed by the solubility of the salts and the clear desirability that the salts should not crystallize out of solution at lower temperatures. Generally, concentrations of 5 to 12% by weight have been found sufficient for practical purposes.

The solution is pale yellow in color, is odorless, is of almost neutral pH and is of low viscosity. In addition, the gluconate and citrate sales are non-hazardous. The solution can therefore be used without recourse to special equipment, protective clothing for personnel or other safety precautions.

The method of the invention is advantageously applied to steel strip during the course of the rinsing step following pickling, as described above. In this context the composition of the invention is suitably applied to both the upper and lower surfaces of the strip by spraying across the whole of the width of the strip before the cessation of movement of the strip through the pickle line. In this respect, it has been found useful to begin spraying the composition of the invention onto the strip as soon as the speed of the strip starts to fall below a certain threshold value. In tests, it has been found especially appropriate to start applying a composition of the invention when the line speed has dropped from its normal operating speed of about 200 m/min to thread speed of about 30 m/min which is the slowest speed at which the line can operate, and is about 1 minute or so away from the line coming to a complete stop. Suitably, the spray is terminated as the steel strip ceases moving. At that stage all parts of the steel strip liable to flash rust will have been sprayed with the composition and sufficient of the composition will have remained on the strip to provide the necessary protection.

Suitably, the composition is applied to the strip upstream of the final hot rinse so that once the rinse line has restarted residual composition is washed from the steel strip by the final hot water rinse. Surprisingly it has been found that even after this final hot water wash the steel surface is resistant to rust, presumably because it has been passivated by the application of the composition of the invention even though downstream analysis has shown that rinsing removes all gluconate and citrate from the steel surface.

The following Examples illustrate the invention.

EXAMPLE 1

Samples (approx. 2×3×1/16" or 50×75×1.6 mm) of production quality mild steel strip from British Steel PLC, Llanwern Works, were immersed in an artificial pickle liquor (10% w/w hydrochloric acid containing 8% w/v iron (II) chloride) for 2 minutes. The samples were then removed and treated as follows:

Sample 1. No further treatment.

Sample 2. Immersion rinsed in demineralized water, removed and allowed to dry.

Sample 3. Sprayed with an aqueous solution of 14.9% by weight sodium gluconate (175 g/L) and 12.8% by weight trisodium citrate (150 g/L) for approximately 10 seconds using a hand held sprayer, immersion rinsed in demineralized water, removed and allowed to dry.

Sample 1 rusted rapidly (within 10 minutes). Sample 2 rusted rapidly (staining apparent after approx. 3 minutes) around the water droplets adhering to the surface. Sample 3 did not rust.

EXAMPLE 2

Tests were carried out in the rinse section of an industrial pickle line using a stain inhibitor having the composition described in Example 1 above, applied at three separate locations within the rinse section, namely through one of the fume exhaust ports at the exit of the acid tanks and two spray heads (approximately 500 mm wide) were set up over each of the squeegee roll sets at the exit of the primary and secondary rinse sections.

The line speed was reduced to thread (30 m/min) and all the sprays were activated for approximately one minute. The line was then stopped for a period to produce the normal conditions conducive to stop stain formation. The test was repeated for different stop times and the following results were observed:

| | Observation | |
|---|---|---|
| Stop Time | Top Surface (Inhibitor Applied) | Bottom Surface (No Inhibitor) |
| 2 | Little or no staining evident, though crawl stain was produced | — |
| 5 | Light sporadic staining was evident, light crawl stain | — |
| 10 | Light sporadic staining was evident, light crawl stain | Heavy staining consistent with long stop in rinse section |

The irregular stains produced on the top surface are believed to be produced where coverage of the inhibitor solution was limited or non-existent. It is clear, however, that the application of inhibitor solution in the rinse sections considerably reduces the extent and severity of stop stains.

We claim:

1. A composition for treating a ferrous metal surface, the composition consisting essentially of an aqueous solution containing from 3 to about 15% by weight each of an alkali metal gluconate and an alkali metal citrate.

2. A composition according to claim 1, containing from 5 to 12% by weight of each of the gluconate and the citrate.

3. A composition according to claim 1, wherein the alkali metal salts are sodium salts.

4. A method for protecting a ferrous metal surface against corrosion which comprises applying to the ferrous surface a composition consisting essentially of an aqueous solution of an alkali metal gluconate and an alkali metal.

5. A method according to claim 4, wherein the composition is applied to the surface of a mild steel strip.

6. A method according to claim 5, wherein the composition is applied to the surface subsequent to pickling.

7. A method according to claim 6, wherein the composition is applied during rinsing subsequent to pickling.

8. A method according to claim 7, wherein the composition is applied in between rinsing stages immediately prior to bringing the mild steel strip to a stop.

* * * * *

UNITED STATES PATENT AND TRADEMARK OFFICE

CERTIFICATE OF CORRECTION

PATENT NO. : 5,916,379

DATED : June 29, 1999

INVENTOR(S) : Michael John Varley and John Bryan Thomas

It is certified that error appears in the above-identified patent and that said Letters Patent is hereby corrected as shown below:

At column 4, line 13, add as the last word in claim 4: --citrate--.

Signed and Sealed this

Ninth Day of May, 2000

*Attest:*

Q. TODD DICKINSON

*Attesting Officer*

*Director of Patents and Trademarks*